US005660332A

United States Patent [19]

Carey et al.

[11] Patent Number: 5,660,332

[45] Date of Patent: Aug. 26, 1997

[54] SPRAY TIP GUARD FOR HYDRAULICALLY OPERATED AIR-LESS SPRAY GUN

[75] Inventors: Danuta H. Carey, Stockholm; John D. Geberth, Ramsey, both of N.J.

[73] Assignee: Titan Tool Inc., Oakland, N.J.

[21] Appl. No.: 503,037

[22] Filed: Jul. 17, 1995

[51] Int. Cl.[6] ..... B05B 1/28

[52] U.S. Cl. ..... 239/288.5

[58] Field of Search ..... 239/288–288.5

[56] References Cited

U.S. PATENT DOCUMENTS

| | | | |
|---|---|---|---|
| 4,025,045 | 5/1977 | Kubiak | 239/288.5 |
| 4,181,261 | 1/1980 | Crum | 239/288.5 |
| 4,331,296 | 5/1982 | Levey | 239/288 |
| 5,285,965 | 2/1994 | McCutcheon | 239/288 |

FOREIGN PATENT DOCUMENTS

| | | | |
|---|---|---|---|
| 1114598 | 12/1981 | Canada | 239/288 |

*Primary Examiner*—Lesley D. Morris

*Attorney, Agent, or Firm*—Bucknam and Archer

[57] ABSTRACT

A spray tip guard for a hydraulically operated air-less spray gun which is generally Y-shaped having forwardly extending diverging ears arranged parallel to the fan spray of the spray pattern issuing from the spray tip of the spray gun. A pair of forwardly extending projections are provided at the apex of the diverging ears adjacent to and on either side of the stream of high pressure liquid emerging from the spray tip so as to provide an obstacle to the approach of the stream of high pressure liquid prior to its being atomized.

1 Claim, 2 Drawing Sheets

SPRAY TIP GUARD FOR HYDRAULICALLY OPERATED AIR-LESS SPRAY GUN

SPECIFICATION

Figure 1:
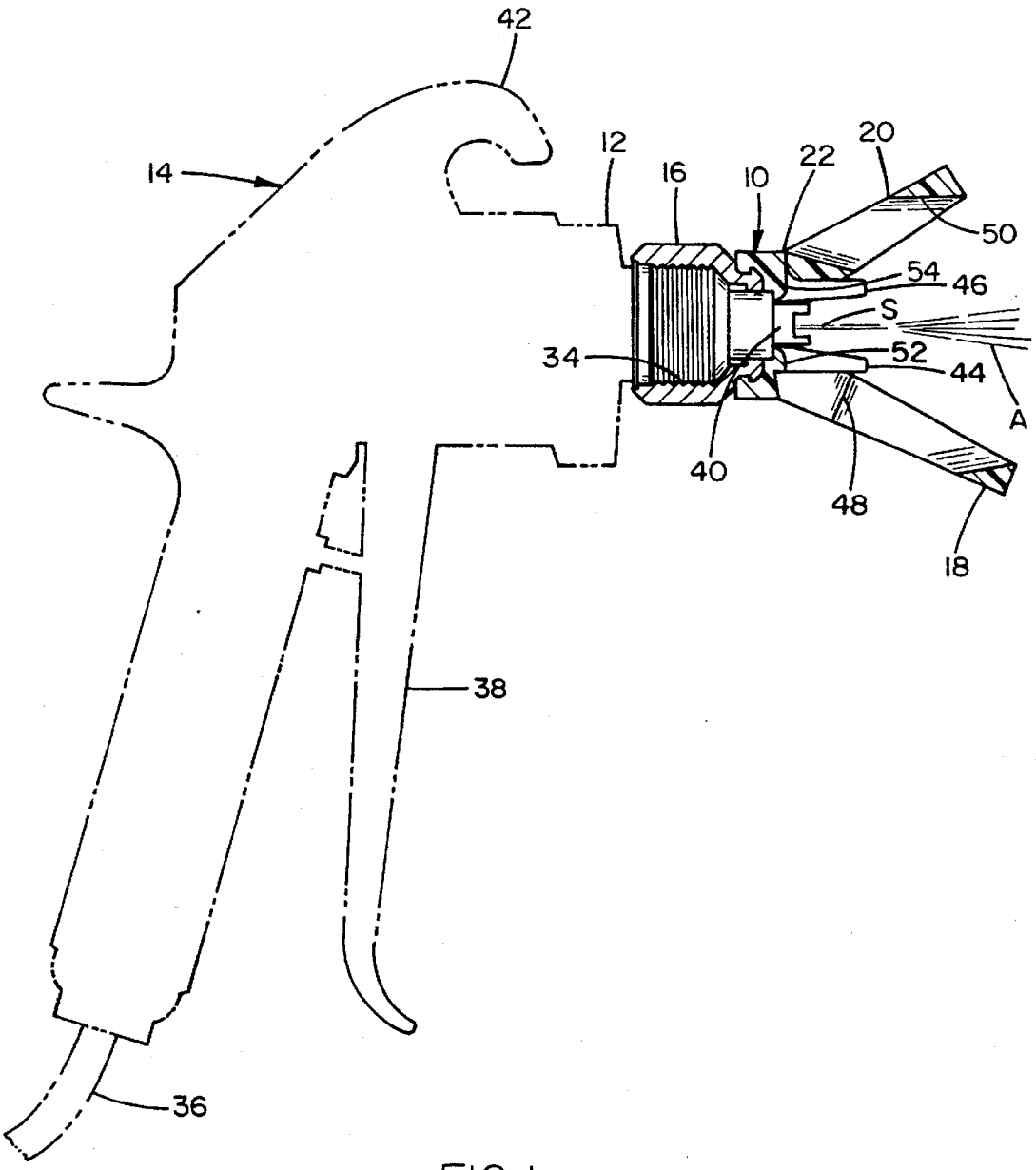

The present invention relates generally to a tip guard for use with spray guns adapted for hydraulically atomizing and spraying liquids such as paint and, more particularly, it relates to such a tip guard with improved and enhanced safety protection.

A method of painting which is used widely in industrial applications is hydraulic or air-less paint spraying. According to this method, liquid paint is delivered to the operator held spray gun under high pressure such that upon exiting the spray tip of the spray gun it is atomized into a spray suitable for spray painting objects. Initially upon exiting the spray tip, the high pressure fluid emerges as a coherent stream which, due to the pressure differential existing upstream and downstream of the spray tip or nozzle, very quickly breaks up into an atomized spray. However, it has long been recognized that as this high pressure fluid exists as a stream from the spray tip of the spray gun it poses a hazard in that it has the capability of penetrating human skin. Such a hazard is a very real problem since the paints and other liquids very often utilized are toxic to the human body and an injection of such liquids can result in serious health consequences.

In order to ameliorate this problem and reduce the hazard of inadvertent injection of the operator or another, a spray tip guard has long been utilized which is generally Y-shaped with flat diverging ears arranged generally parallel to the fan of the spray pattern and extending sufficiently forward of the spray tip to insure against injection hazard. In practice it has been found that a spray tip guard of a few inches or less in length is sufficient to avoid inadvertent injection. An example of such a spray tip guard can be found in U.S. Pat. No. 3,952,955, to Clements, granted Apr. 27, 1976. However, as noted, the ears of such spray tip guards are diverging from the spray tip so that the guards are effective in preventing relatively large objects, such as arms and hands, from approaching too near the spray tip but are not truly effective in preventing small objects from approaching the spray tip. Thus, it is possible in spite of the tip guard for the operator to inadvertently place a finger or some small part of the hand within the Y-shaped opening of the spray tip guard and sufficiently close to the spray tip to be accidentally injected with the stream of emerging high pressure paint.

It is, therefore, a primary object of the present invention to provide a spray tip guard for a spray gun adapted to hydraulically atomize liquids such as paint which has an improved capacity to prevent the inadvertent injection of the high pressure fluid stream emerging from the spray tip into the human body.

The above object is accomplished in accordance with the present invention by the provision of a generally Y-shaped tip guard for a spray gun adapted for hydraulically atomizing and spraying liquids such as paint which further includes two forwardly extending protrusions or projections arranged on either side of the stream of high pressure fluid at the apex of the diverging ears of the tip guard which are generally parallel to the emerging stream of high pressure fluid.

Other objects and features of the present invention will become apparent from the following detailed description thereof when considered in connection with the accompanyings. It is to be understood, however, that the drawings are designed as an illustration only and not as a definition of the limits of the invention.

Figure 2:
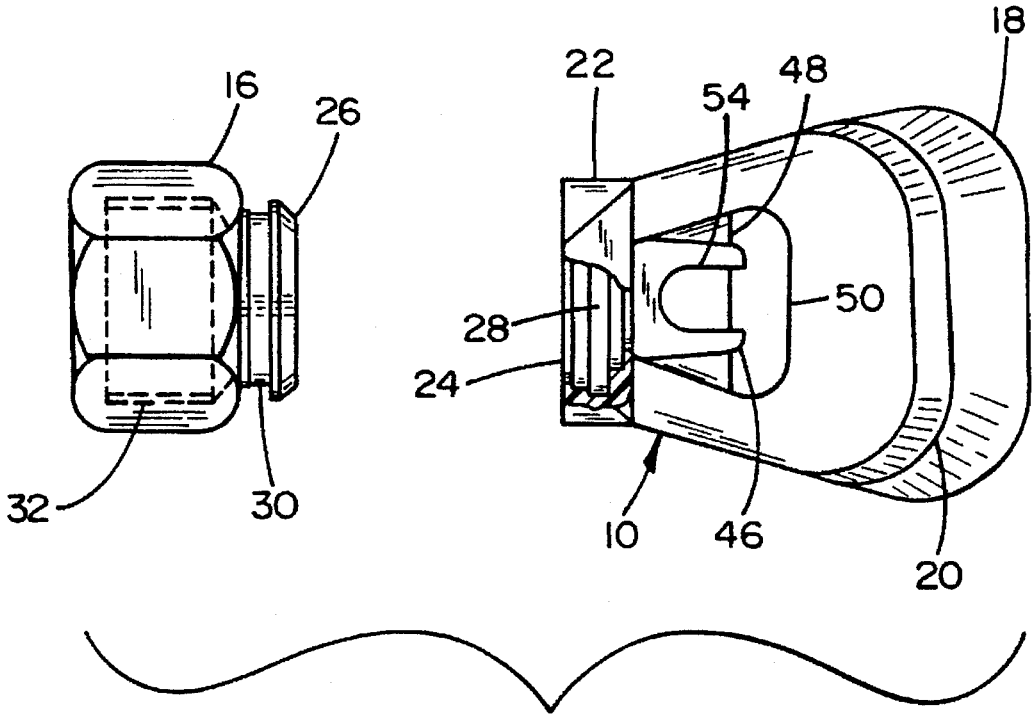

In the drawings, wherein similar reference characters denote similar elements throughout the several views:

FIG. 1 is a side elevational view, partly in cross section, of the spray tip guard according to the present invention mounted on a hydraulically operated air-less spray gun; and FIG. 2 is a top plan view of the spray tip guard according to the present invention.

Now turning to the drawings, there is shown in FIG. 1 a spray tip guard, generally designated 10, mounted onto the forward end of barrel 12 of spray gun 14 (shown in phantom) by means of retaining nut 16. Spray tip guard 10 is preferably formed of plastic for ease of manufacture and because of its low cost. As clearly seen, tip guard 10 is generally Y-shaped having flat diverging ears, designated 18 and 20, extending forwardly from a base 22. Base 22 has a centrally disposed axial opening 24 extending therethrough which receives a forward extension 26 of retaining nut 16 therein (see FIG. 2). Tip guard 10 is rotatably mounted to retaining nut 16 by the engagement of annular boss 28 in opening 24 with annular groove 30 on extension 26 of retaining nut 16. Retaining nut 16 is provided with internal threads, designated 32, adapted for threaded engagement with external threads, designated 34, at the forward end of barrel 12 of air-less spray gun 14.

As clearly seen, hydraulic spray gun 14 communicates with a source of high pressure fluid, such as paint, via flexible hose 36 (shown in phantom). The high pressure fluid is conducted through spray gun 14 to the forward end of barrel 12 thereof and the passage therethrough is controlled by trigger 38 of the spray gun. A spray tip, designated 40, is securely fastened to the forward end of barrel 12 by means of retaining nut 16 and extends through axial opening 24 in base 22 of tip guard 10. Spray tip 40 is thus located at the apex of diverging ears 18 and 20. The forwardly extending ears 18 and 20 of tip guard 10 can be axially rotated and thus adjusted with respect to the fan spray issuing from spray tip 40 so as not to interfere therewith. Spray gun 14 is also provided with a hook member, designated 42, for ease in hanging spray gun 14 when it is temporarily not in use during the painting operation.

As described hereinabove, the high pressure fluid exiting spray tip 40 does so as a substantially cohesive stream prior to the atomization of the fluid. The cohesive stream is depicted in FIG. 1 and designated S whereas the atomized spray is designated A. Stream S extends forwardly of spray tip 40 and is sufficiently cohesive to pose an injection hazard for a distance of up to approximately ⅝ inch at which point the liquid is atomized at A. In order to further increase the safety feature of spray tip guard 10 by obstructing the approach to spray tip 40 and preventing the possible insertion of a small human body member, for example a finger, into the path of fluid stream S, preferably identical protrusions or projections 44 and 46 are provided substantially parallel to and on either side of stream S. Projections 44 and 46 extend forwardly for a distance slightly exceeding the length of stream S and are arranged proximate to stream S and to each other.

As clearly seen in FIG. 2, each of the flat diverging ears 18 and 20 is provided with an aperture, designated 48 and 50, respectively, for the purpose of permitting adequate and unobstructed air flow to the high pressure liquid stream S emerging from spray tip 40 so as to aid in the atomization of the fluid and formation of the fan spray. Each of the projections 44 and 46 can be generally flat and arranged generally parallel to diverging ears 18 and 20. Preferably, projections 44 and 46 are bifurcated or U-shaped, as seen in FIG. 2, to form apertures 52 and 54, respectively. As seen in FIG. 1, apertures 52 and 54 of projections 44 and 46 are disposed laterally of high pressure liquid stream S so as to avoid a build up of paint on flat projections 44 and 46.

It is to be understood that the foregoing general and detailed descriptions are explanatory of the present invention and are not to be interpreted as restrictive of the scope of the following claims.

What is claimed is:

1. A spray tip guard for use with a hydraulically operated airless spray gun having a spray tip from which emerges a stream of high pressure liquid which stream has a length determined by the distance from said spray tip whereat said stream atomizes and forms a fan spray pattern, said spray tip guard comprising:

a) a pair of forwardly extending diverging ears arranged substantially parallel to the fan spray pattern of said atomized stream and forming a substantially Y-shape;

b) an aperture arranged in each of said pair of diverging ears disposed laterally of said stream of high pressure liquid emerging from said spray tip;

c) a pair of forwardly extending projections disposed generally at the apex of said Y-shaped diverging ears proximate and parallel to the stream of high pressure liquid emerging from said spray tip and having a length at least equal to the length of said high pressure stream, each of said projections is bifurcated to form a substantially U-shaped projection whose aperture is disposed laterally of said stream of high pressure liquid emerging from said spray tip and aligned with the apertures of said diverging ears; and d) a retaining nut rotatably mounted on a base of said spray tip guard for threaded engagement with the barrel of the spray gun to retain the spray tip thereon.

* * * * *